United States Patent [19]

Pham

[11] Patent Number: 4,698,468

[45] Date of Patent: Oct. 6, 1987

[54] SULPHUR HEXAFLUORIDE CIRCUIT BREAKER USABLE AT VERY LOW OUTSIDE TEMPERATURES

[75] Inventor: Van Doan Pham, Meyzieu, France

[73] Assignee: Alsthom, Paris Cedex, France

[21] Appl. No.: 38,579

[22] Filed: Apr. 15, 1987

[30] Foreign Application Priority Data

Apr. 28, 1986 [FR] France ..... 86 06126

[51] Int. Cl.[4] ..... H01H 33/57; H01H 33/70

[52] U.S. Cl. ..... 200/148 B; 200/148 E; 200/148 G

[58] Field of Search ..... 200/148 E, 148 B, 148 G, 200/148 R

[56] References Cited

U.S. PATENT DOCUMENTS

| | | | |
|---|---|---|---|
| 3,356,810 | 12/1967 | Kessler et al. | 200/148 B |
| 3,703,619 | 11/1972 | Henry | 200/148 E |
| 3,842,226 | 10/1974 | Yoon | 200/148 E |
| 3,985,987 | 10/1976 | Patel | 200/148 G |

*Primary Examiner*—Robert S. Macon

*Attorney, Agent, or Firm*—Sughrue, Mion, Zinn, Macpeak and Seas

[57] ABSTRACT

A sulphur hexafluoride circuit breaker usable at very low outside temperatures, the circuit breaker comprising:

a sealed enclosure containing a fixed contact assembly and a moving contact assembly;

a drive rod for driving the moving contact assembly, said rod being connected to a drive mechanism;

a blast volume;

a blast nozzle; and a condenser located outside the enclosure and disposed in the vicinity of said drive mechanism and connected to the same potential, with the inside of the condenser being put into communication with the inside of the circuit breaker via at least one duct;

the circuit breaker including the improvement of first means (108B, 109, 109A) for permanently taking a portion of the liquefied gas in the condenser and for vaporizing it by heating, and second means (300) for conveying the resulting vapor into a thermally insulating enclosure, said enclosure being located in the vicinity of the arcing zone within the circuit breaker and communicating with the blast volume via an orifice.

7 Claims, 3 Drawing Figures

SULPHUR HEXAFLUORIDE CIRCUIT BREAKER USABLE AT VERY LOW OUTSIDE TEMPERATURES

The present invention ralates to a sulphur hexafluoride ($SF_6$) circuit breaker usable at very low outside temperatures.

BACKGROUND OF THE INVENTION

When a circuit breaker containing sulphur hexafluoride at a pressure of several bars is placed in a very low ambient temperature (e.g. less than −20° C.), a portion of the dielectric $SF_6$ gas condenses. This reduces the apparatus' circuit-breaking capacity and increases the risk of internal arcing.

One known way of solving these drawbacks is to provide such a circuit breaker with means for heating the gas in its current-interrupting chamber.

Such means are effective only if considerable heating power is used, and in any event cannot prevent the risk of $SF_6$ condensing on the porcelain walls of the circuit interrupting chamber and its support, and it is such condensation which gives rise to the above-mentioned arcing.

Preferred embodiments of the invention provide a circuit-breaker requiring such heating at very low power only.

This is done using a circuit breaker of the type described in French Pat. No. 85 074 37 filed May 15, 1985 (published under the number 2 582 145 and equivalent to U.S. patent application Ser. No. 862 941 filed May 14th, 1986), which includes a condenser outside the envelope and at ground potential, said condenser being associated with means for heating the liquefied $SF_6$ in the condenser.

SUMMARY OF THE INVENTION

According to the present invention the circuit breaker is provided with an insulating tube to convey the gas which has been vaporized and heated in this manner and to deliver it into a thermally insulated enclosure placed in the vicinity of the blast volume and in communication therewith.

In this way, as explained below, a zone containing dielectric gas at a density and a temperature higher than the density and temperature existing elsewhere in the circuit breaker is maintained in the vicinity of the arcing zone, thereby facilitating circuit interruption.

BRIEF DESCRIPTION OF THE DRAWINGS

An embodiment of the invention is described by way of example with reference to accompanying drawings, in which.

MORE DETAILED DESCRIPTION

Figure 1:
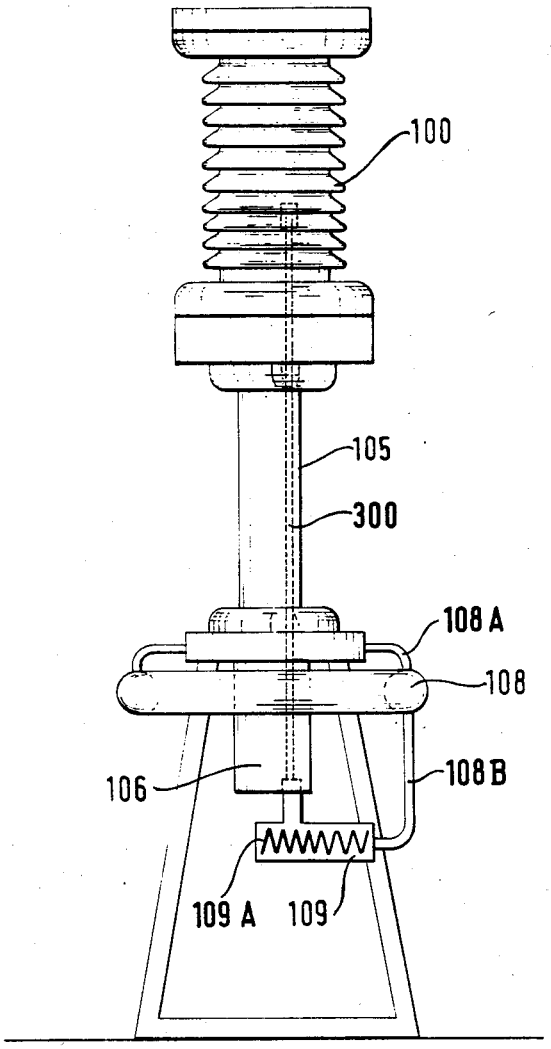
FIG. 1 is an elevation view of one pole of a circuit breaker in accordance with the invention.

FIG. 1 shows one pole of an $SF_6$ circuit breaker. It comprises a porcelain column 100 delimiting a current-interrupting chamber, an insulating support 105 containing an operating rod (not shown), and an enclosure 106 enclosing an operating mechanism (not shown).

A condenser 108 (for example in the form of a metal torous) is disposed at the base of the circuit breaker and is connected to ground potential.

The condenser communicates via ducts 108A with the inside of the circuit breaker and allows the gas to condense while preventing the gas from condensing elsewhere, and in particular while preventing it from condensing on the porcelain walls.

The liquefied gas is conveyed by a duct 108B to a heater 109 which is associated with a heating member 109A (preferably an electrical resistance element).

A tube 300 of insulating material runs from the heater 109 and penetrates in sealed manner into the circuit breaker to extend to the vicinity of the circuit-interrupting zone.

Figure 2:
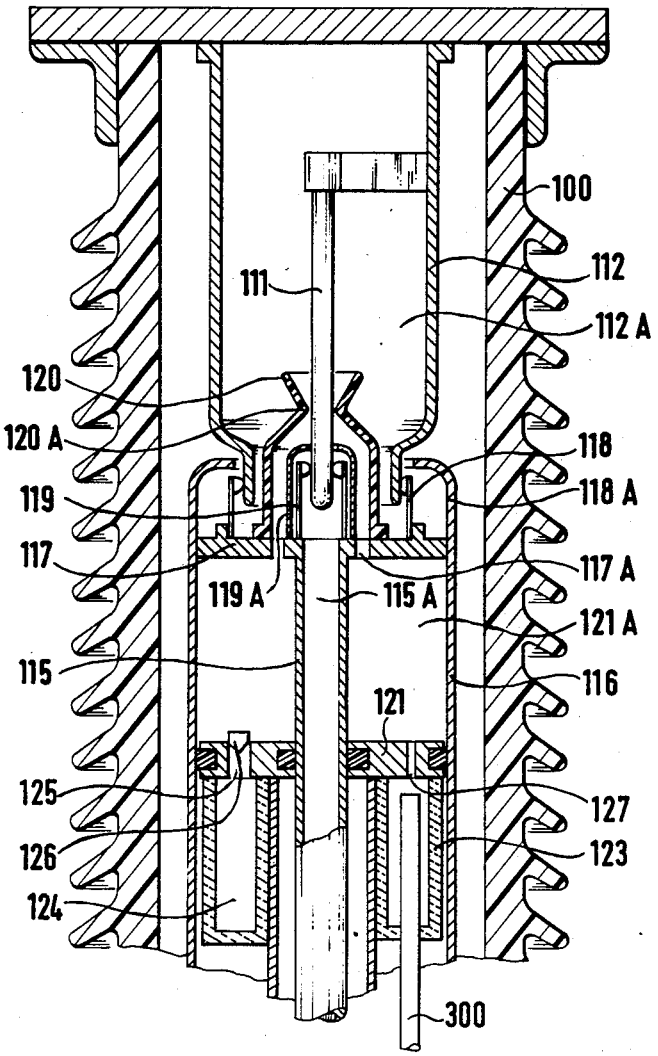
FIG. 2 is a fragmentary axial section through the circuit-interrupting chamber of the FIG. 1 circuit breaker shown in its closed position.

Reference is now made to FIG. 2. The circuit-interrupting chamber includes a fixed arcing contact 111, a fixed tubular contact 112 (delimiting a volume 112A), and a moving assembly including an operating rod 115 fixed to a cylinder 116 which is closed by a disk 117. The rod is hollow and delimits a volume referenced 115A.

The disk 117 has main contact fingers 118, arcing contact fingers 119, and a blast nozzle 120. The moving assembly also includes a corona discharge arrester 118A and a spark arrester 119A.

A blast volume 121A is delimited by the disk 117, the cylinder 116, and a fixed piston 121.

Holes 117A through the disk 117 provide communication between the volume 121A and the inside of the blast nozzle.

An enclosure 123 is provided above the fixed piston 121 and is closed, fixed, and thermally insulated by virtue of having walls made of a material which is a poor conductor of heat. The volume 124 of this enclosure communicates with the volume 121 via a small diameter orifice 127 and via a plurality of larger diameter orifices 125 fitted with non-return valves 126.

The tube 300 opens out into the enclosure 123. The volume 124 of the enclosure 123 is slightly smaller than the blast volume 121A.

When the circuit breaker is closed (FIG. 2), the gas heated by the resistance element 109A arrives in the enclosure via the tube 300 and passes via the hole 127 from said enclosure into the volume 121A where it mixed with the gas in this volume.

This mixture then escapes via the holes 117A and the throat 120A of the nozzle 120 into the space 112A.

The gas in the blast volume 121A is always at higher temperature and greater density than the gas in the volume 112A.

When the circuit breaker is opened, the blast gas injected into the nozzle is thus at a relatively high density, thereby facilitating current interruption.

Figure 3:
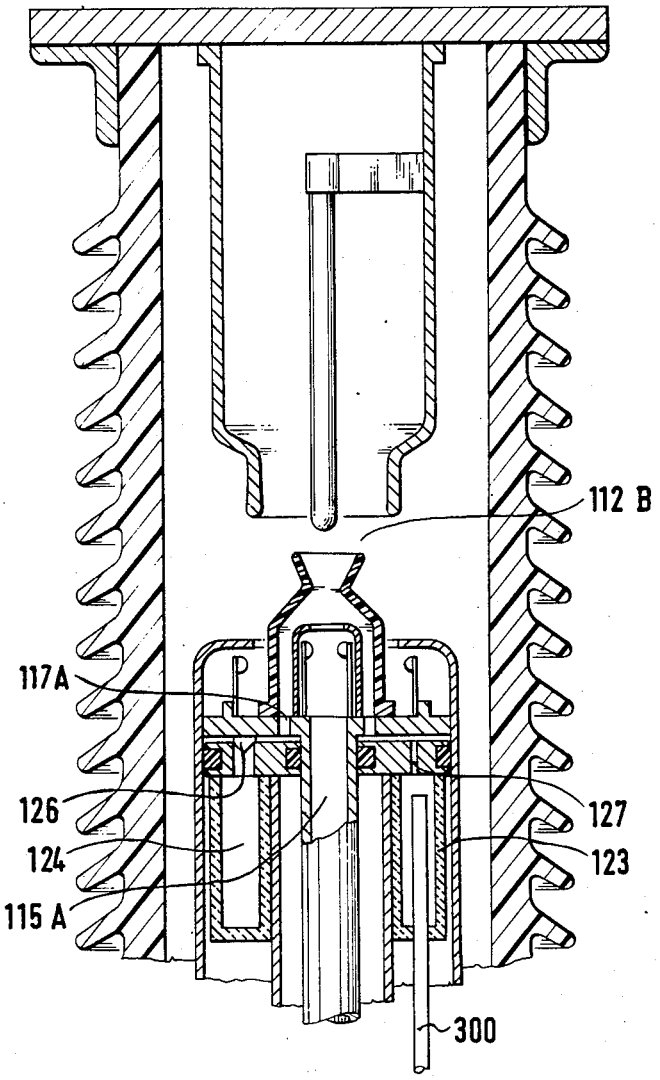
FIG. 3 is a fragmentary axial section through the current-interrupting chamber of the FIG. 1 circuit breaker shown in its open position.

When the circuit breaker is open (FIG. 3), and a close-open cycle is to be performed, the volume of gas 124 is used to fill the volume 121A with high density hot gas rapidly by suction through the non-return valves 1126. As a result, the gas contained in the volume 121A at the end of the close half-cycle is sufficiently hot and dense to ensure that current interruption takes place reliably during the subsequent opening half-cycle.

When the circuit breaker is in the open position (FIG. 3), gas escapes continuously from the volume 124 via the hole 127 and the holes 117A into the space 112B.

The hole 127 has a section which is equivalent to the leakage past the fixed arcing contact (or more precisely between its spark-arresting end 119A and the throat 120A of the nozzle 120).

In accordance with the invention, instead of heating the entire volume of the circuit breaker, heat is applied only to that quantity of gas in the volume 121A which is required to effect current interruption. This means that relatively low heating power can be used and there is little risk of gas condensing on the walls of the envelope 100.

I claim:

1. A sulphur hexafluoride circuit breaker usable at very low outside temperatures, the circuit breaker comprising:

a sealed enclosure containing a fixed contact assembly and a moving contact assembly;

a drive rod for driving the moving contact assembly, said rod being connected to a drive mechanism;

a blast volume;

a blast nozzle; and a condenser located outside the enclosure and disposed in the vicinity of said drive mechanism and connected to the same potential, with the inside of the condenser being put into communication with the inside of the circuit breaker via at least one duct;

the circuit breaker further comprising first means for permanently taking a portion of the liquefied gas in the condenser and for vaporizing it by heating, and second means for conveying the resulting vapor into a thermally insulating enclosure, said enclosure being located in the vicinity of the arcing zone within the circuit breaker and communicating with the blast volume via an orifice.

2. A circuit breaker according to claim 1, wherein said first means comprise a heater placed at a lower level than said condenser and connected to said condenser by a duct.

3. A circuit breaker according to claim 2, wherein the second means comprise a tube of insulating material, opening out at one end into said heater and at the other end into said thermally insulated enclosure.

4. A circuit breaker according to claim 1, wherein the blast volume is delimited by a fixed piston and a cylinder linked to the drive rod, said thermally insulating enclosure being disposed on the other side of the piston from the blast volume and being in permanent communication with said blast volume via a hole through the fixed piston.

5. A circuit breaker according to claim 4, wherein the hole has a section chosen to be equivalent to the leakage section past the fixed arcing contact.

6. A circuit breaker according to claim 1, wherein the blast volume communicates with the thermally insulating enclosure via holes provided with non-return valves which open only during a closure movement of the circuit breaker.

7. A circuit breaker according to claim 1, wherein the volume of the thermally insulated enclosure is not more than the blast volume.

* * * * *